US008166707B2

(12) United States Patent
Franschman

(10) Patent No.: US 8,166,707 B2
(45) Date of Patent: May 1, 2012

(54) REINFORCED DOOR JAMB ASSEMBLY

(76) Inventor: Michael Franschman, Thornhill (CA)

( * ) Notice: Subject to any disclaimer, the term of this patent is extended or adjusted under 35 U.S.C. 154(b) by 935 days.

(21) Appl. No.: 12/122,548

(22) Filed: May 16, 2008

(65) Prior Publication Data

US 2009/0282745 A1 Nov. 19, 2009

(51) Int. Cl.
*E05D 1/00* (2006.01)

(52) U.S. Cl. ..... 49/460; 292/346

(58) Field of Classification Search ..... 49/460, 49/504; 292/340, 346; 70/1.5, 416, 417, 70/448, 450
See application file for complete search history.

(56) References Cited

U.S. PATENT DOCUMENTS 2,533,396 A * 12/1950 Payne ..... 292/340
4,416,087 A * 11/1983 Ghatak ..... 49/462
4,640,052 A * 2/1987 Zebedee et al. ..... 49/383
4,717,185 A * 1/1988 Hartley ..... 292/340
4,953,901 A * 9/1990 Hegdahl ..... 292/340
5,344,198 A * 9/1994 Elliott ..... 292/340
5,474,347 A * 12/1995 Vigneault et al. ..... 292/340
5,566,995 A * 10/1996 Jagiela ..... 292/346
6,557,914 B2 * 5/2003 Hamilton et al. ..... 292/340
6,857,672 B1 * 2/2005 Drew, II ..... 292/341.18
2003/0014922 A1 * 1/2003 Olberding et al. ..... 49/460
2003/0084616 A1 * 5/2003 Kimball ..... 49/504

* cited by examiner

*Primary Examiner* — Jerry Redman

(74) *Attorney, Agent, or Firm* — Nasser Ashgriz

(57) ABSTRACT

A reinforced door jamb and method thereof, to prevent breaking of a lock. A doorjamb is reinforced by inserting one or two reinforced plates into the door jamb. One plate is inserted close to the door latch receiving recess on the interior side of the door jamb, and the other plate is inserted close to the exterior side of the door jamb. The reinforced plates are then connected to each other using high strength rods or bolts.

4 Claims, 7 Drawing Sheets

REINFORCED DOOR JAMB ASSEMBLY

FIELD OF THE INVENTION

The present invention relates to door reinforcement assemblies and in particular to reinforcement of door frames and door jambs in order to reduce the risk of a forced entry attempt

BACKGROUND OF THE INVENTION

A door jamb is the vertical portion of a door frame onto which a door is secured. Most types of door fasteners and deadbolts extend into a recess within the door jamb when in the locked position, making the strength of the door jamb and door frame vitally important to the overall security of the door.

Given an actual door width, the limited area on the door in which to install the dead bolt, and that the door itself is installed flush to the door jamb, the corresponding hole (recess) to accept the dead bolt ends up being located extremely close to the edge of the door jamb, making this area the weakest part of the door assembly. This is due to the fact that the remaining wood left between the recess and the edge of the door jamb is relativity small, in most cases just over ¼ inch When the door is struck with a force, this force is transferred from the door to the dead bolt or latch bolt, which when inserted into the door jamb, transfers that force onto the wooden jamb With a large enough force, the door jamb breaks allowing forced entry to occur. Traditionally, in order to reinforce the jamb, a metal plate, called a strike plate, is mounted with screws onto the jamb itself vertically between the door jamb and the door The strike plate has an opening which is similar in size as the recess inside the door jamb However, moderate forces can still break the door jamb even with different size strike plates installed Numerous door reinforcement assemblies have been invented in order to protect doors and prevent breaking of a door jamb Many of the reinforcements are variations of the strike plate. These types of reinforcements are mainly fastened to the bolt receiving face of the jamb For instance, U.S. Pat. No. 5,456,507 issued to Jones discloses a strike plate assembly having numerous pins that extend through the door jamb and into the door support structure behind the door jamb. U.S. Pat. No. 5,241,790 issued to Schimpf disclosed a plate mounted on the face of the jamb, in the space between the jamb and the door frame. In order to install the reinforcing plate behind the door jamb, the interior trim strip is removed from the door frame and the reinforcing plate is mounted behind the door jamb Some of the door reinforcement assemblies are fastened to the sides of the jamb U.S. Pat. No. 4,074,484 issued to Queren, discloses a plate which is screwed to the wall studs and the door frame side rail. If a door is struck hard, the screws will pop and door opens Reinforcements can also be affixed to both the face and the sides of the jamb For instance, U.S. Pat. No. 6,857,672 issued to Drew discloses a U shaped piece which is installed on the face of the jamb The sidewalls which extent to the sides of the jamb include holes for fastening the piece to the door frame. U.S. Pat. Nos. 6,085,465, 6,305,127 and 6,430,876 issued to Olberding disclose a strike plate with an additional plate projected transversely from the flat surface plate Said transverse projection locates alongside of the door jamb and it can be screwed into the door jamb for reinforcement U.S. Pat. No. 5,566,509 issued to Long discloses an elongated reinforcement strip having an L-shaped transverse cross-section of one short leg and one long leg, the long leg for mounting on a door jamb face and the short leg for mounting on a door jamb edge U.S. Pat. No. 4,858,384 issued to Blankenship discloses an elongate support plate having an L-shaped cross section with a first side to overlap the inside of a door jamb and a second side to overlap the front of a door jamb. And U.S. Pat. No. 5,070,650 issued to Anderson discloses a flat elongate metal plate adapted to overlie a portion of the inner bolt receiving face of a door jamb and a thin elongate metal plate having an L-shaped cross-section and including a first side adapted to overlie the first metal plate and a second side adapted to be slidably inserted beneath the decorative molding and the outer face of the door jamb.

U.S. Pat. No. 4,416,087 issued to Ghatak, discloses reinforcing rods positioned internally along the depth of a door jamb adjacent the bolt receiver or striker plate. The rods use a brace bar positioned on the edge of the door jamb. The brace bar is exposed once the door is opened. Ghatak's invention requires modification of the door frame in order to be installed. The door trim must be removed, the bars are installed, then modification to the door trim is made, and then the modified trim is re-attach to the door jamb. In addition, it is not concealed, located between the door jamb and door trim, and will be obvious from the outside once the door is opened.

One advantage of the present invention over the prior art is that once installed, the device is concealed and therefore cannot be seen from the outside But its more important advantage is that there is no need to make any major modifications to the exiting door assembly. It can be installed on any wooded door jamb without removing any part of the door frame, door jamb or its decorative trim.

The prior art taken either singly or in combination, is seen to describe the instant invention as claimed.

SUMMARY OF THE INVENTION

The present invention relates to a door jamb reinforcement assembly and a method of installing reinforcements into door jambs An object of the present invention is to reduce the risk of breaking a door jamb and therefore allowing a forced entry attempt. Another object of the present invention is to provide a reinforcement assembly that can be implemented on any of the existing door jambs, mainly wooded door jambs, with minimal modification and without a need to replace the lock, jamb or decorative trim Another object of the present invention is that it can be installed in a very short time, reducing the retrofit and installation cost The reinforcement assembly of the present invention comprises of a reinforcement plate, made or a metal of any other high strength material, which is inserted directly into the door jamb perpendicular to the lock receiving face of the door jamb. The reinforcement plate is wide enough to extend into the depth of the door jamb, and it is long enough to extend pass the latch and lock receiving recesses inside the jamb The plate also has at least two apertures at its two edges to receive reinforcing bolts The door jamb is then reinforced by bolting the door jamb and the reinforcement plate together using bolts inserted into the interior side of the jamb in the parallel direction to the face of the jamb. The bolts extend only partly through the width of the door jamb, and not all the way through The bolts are then secured by nuts, preferably barrel nuts It is therefore an object of this invention to provide a door jamb reinforcing means which overcomes the prior art deficiencies The main object of the present invention is to keep the door jamb or the door frame under stress and tension Increased tension in the wood result in an increase in its strength against attempts to break it It is also an object of this invention to have a reinforcement that is concealed, universal to fit all wood framed doors and easy to install. Most of the disclosed door reinforcement assemblies are very obstructive and undesirably prominent The prior art has not attempted to conceal the reinforcement assembly without sacrificing reinforcement strength Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

Figure 1:
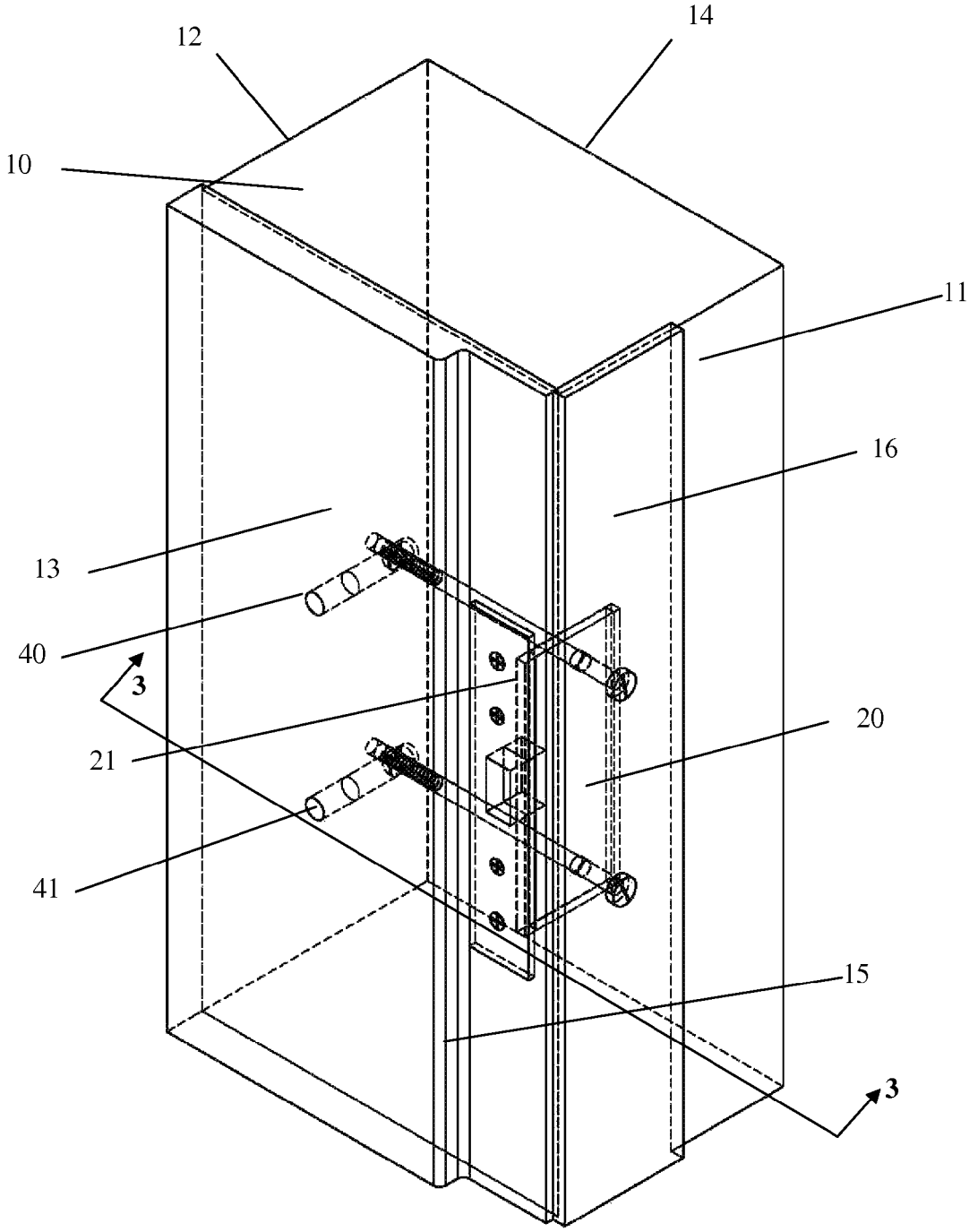
FIG. 1 shows a perspective view of a section of a door jamb together with the reinforcement assembly of the present invention.

The object of the present invention is to disclose a method and an assembly to reinforce door jambs. The method can be implemented on any existing wood door frame with a lock. The method comprises of first scribing a line parallel to the inside hole of the original strike plate The original strike plate is then removed The installation template is now secured onto the outside of the door jamb with screws which will also now provides alignment holes that are used to drill out the section to accept the bolts. Once the template is installed, a predefined slot is routed into the door jamb with certain depth, certain length and certain thickness. The depth of the slot is just enough to countersink and therefore conceal the metal reinforcement plate which will be inserted within this slot. This method also allows for the utilization of the door frame for strength as well The slot is long enough to receive at least two bolts, whereas the bolts pass below and above the dead bolt recess in the jamb. Next, two holes are drilled horizontally through the door jamb used to accept the bolts The drilled holes go through the recently created slot in the door jamb, preferably close to the two ends of the slot Once completed, the template is removed and the two screw holes that remain from the template removal are now made larger by drill to accept the receiving nuts. Then a plate preferably made of a reinforced metal or any other strong material, cut to the size of the slot on the door frame and having at least two apertures, is inserted into the slot The apertures in the plate have to be aligned with the apertures inside the door jamb. At least two bolts are inserted into the apertures of the door jamb and through the apertures of the plate At least two nuts are inserted into the aperture of the other holes which are used to tighten the bolts The nuts are positions in the interior of the door jamb, where there is no access and no way of removal A new strike plate is now installed back in place of the original but completely covering the metal plate insert while still allowing for the recess opening in the door jamb. The surfaces of the remaining openings can be capped with custom caps or filled with wood fillers for concealment. The heads of the bolts are also hidden under custom made caps so that they are not visible from the outside The method described here makes the door frame strong enough that it cannot be easily broken into A more detailed description of a preferred embodiment of the present invention is provided by referring to FIGS. 1 to 3. FIG. 1 shows an isometric view of a section of the door jamb close to the latch which illustrates a preferred embodiment of a reinforced door jamb. Door jamb 10 having an interior side 11, an exterior side 12, and a latch or bolt receiving side or face, 13. Door jamb having a width 14, also referred to as its lateral direction in this disclosure. There is a door stop 15 on the face of the door jamb and a door trim 16 on the side of the door jamb. Door jamb is reinforced by a high strength plate 20 inserted into a pre-routed slot 21 in the door jamb. Plate 20 can be of any high strength material, preferably of a high strength steel. Slot 21 is routed inside the door jamb by first removing a preexisting striker plate 22. Slot 21 is routed close to a bolt receiving recess 23 inside the door jamb. Two openings are drilled into the door jamb from the interior side of the door jamb 11 Two openings 30 and 31 extend laterally through the door jamb, to about ⅔ of the width of the door jamb. Two other openings are drilled on the face of the door jamb, 40 and 41, at about ⅔ of the width of the door jamb and aligned with the lateral holes 30 and 31. Openings 40 and 41 are drilled deep enough to reach openings 30 and 31. The diameters of the openings are large enough to receive standard bolts, like a ¼ in bolts. Bolts 32 and 33 are inserted into the openings 30 and 31, respectively, and bolted using nuts 42 and 43 which are inserted into openings 40 and 41, respectively Nuts 42 and 43 can be any type of nut, preferably, barrel nuts. Once the bolts are fastened, the door jamb is reinforced by sandwiching the door jamb between the metal plate and the nuts This keeps the wood under tension and make is difficult to break. The openings on the door jamb can be capped or filled with wood filler compound to conceal the reinforcement.

Figure 2:
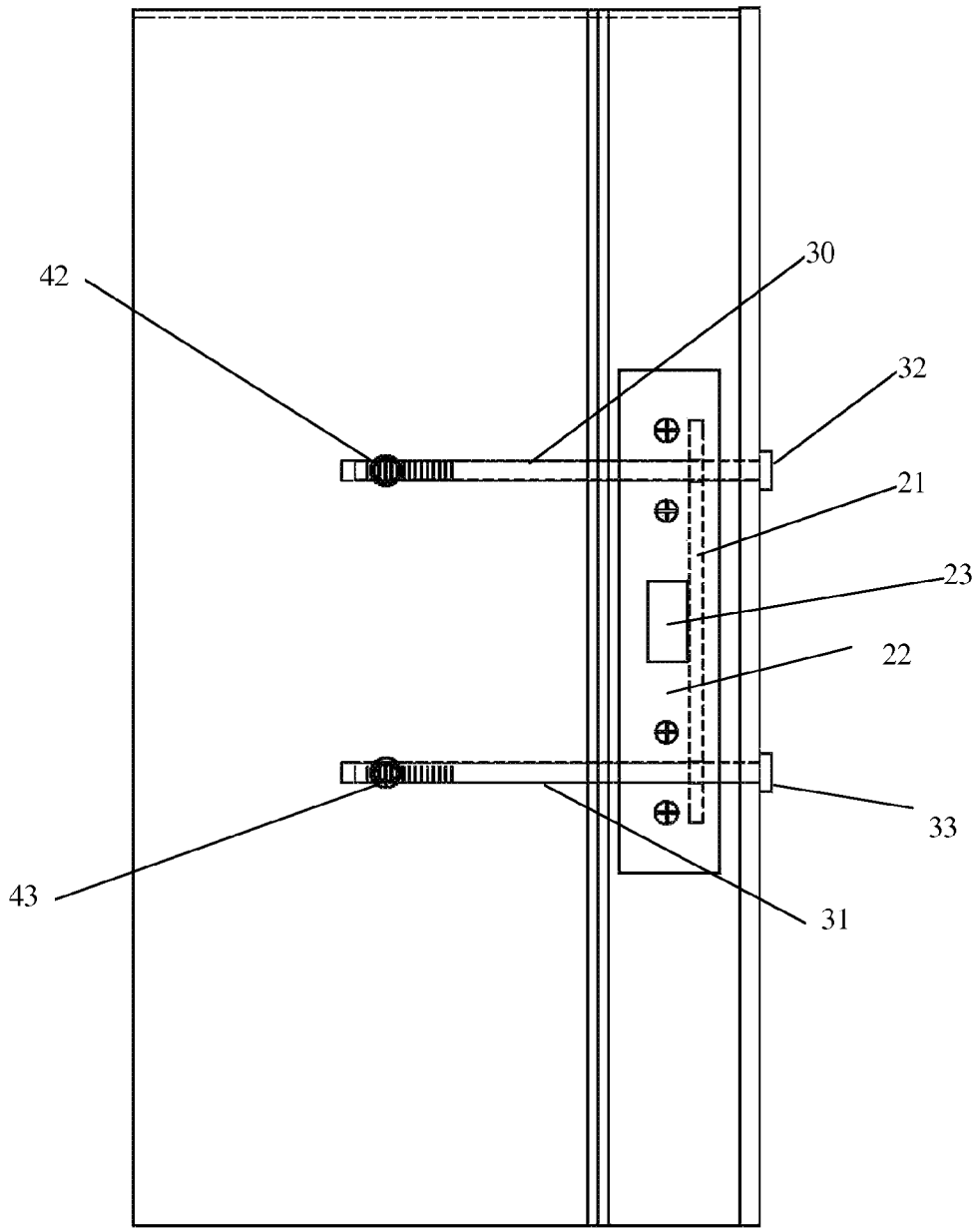
FIG. 2 illustrates a side view of the preferred embodiment of this invention
Figure 3:
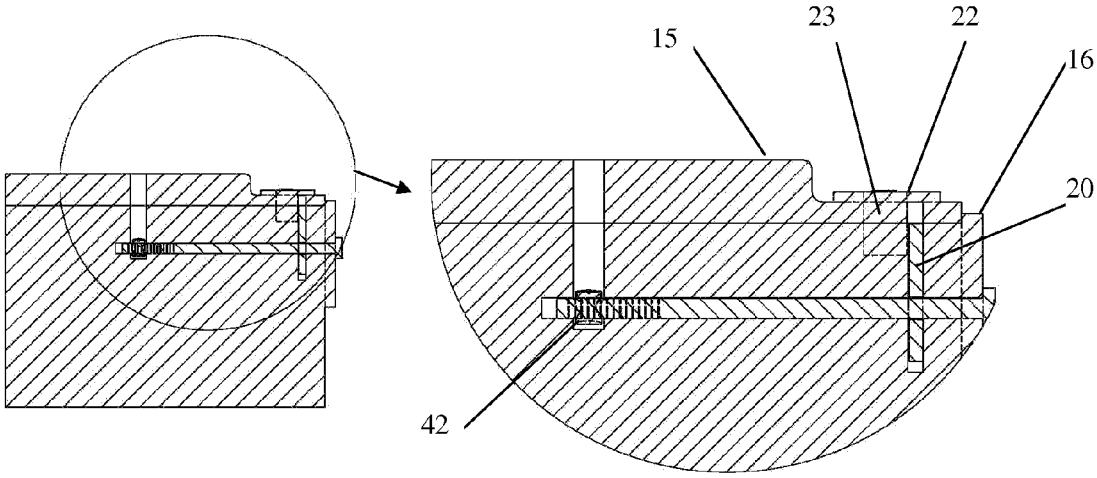
FIG. 3 illustrates an enlarged cross sectional view of a section of the door jamb reinforcement assembly.
Figure 4:
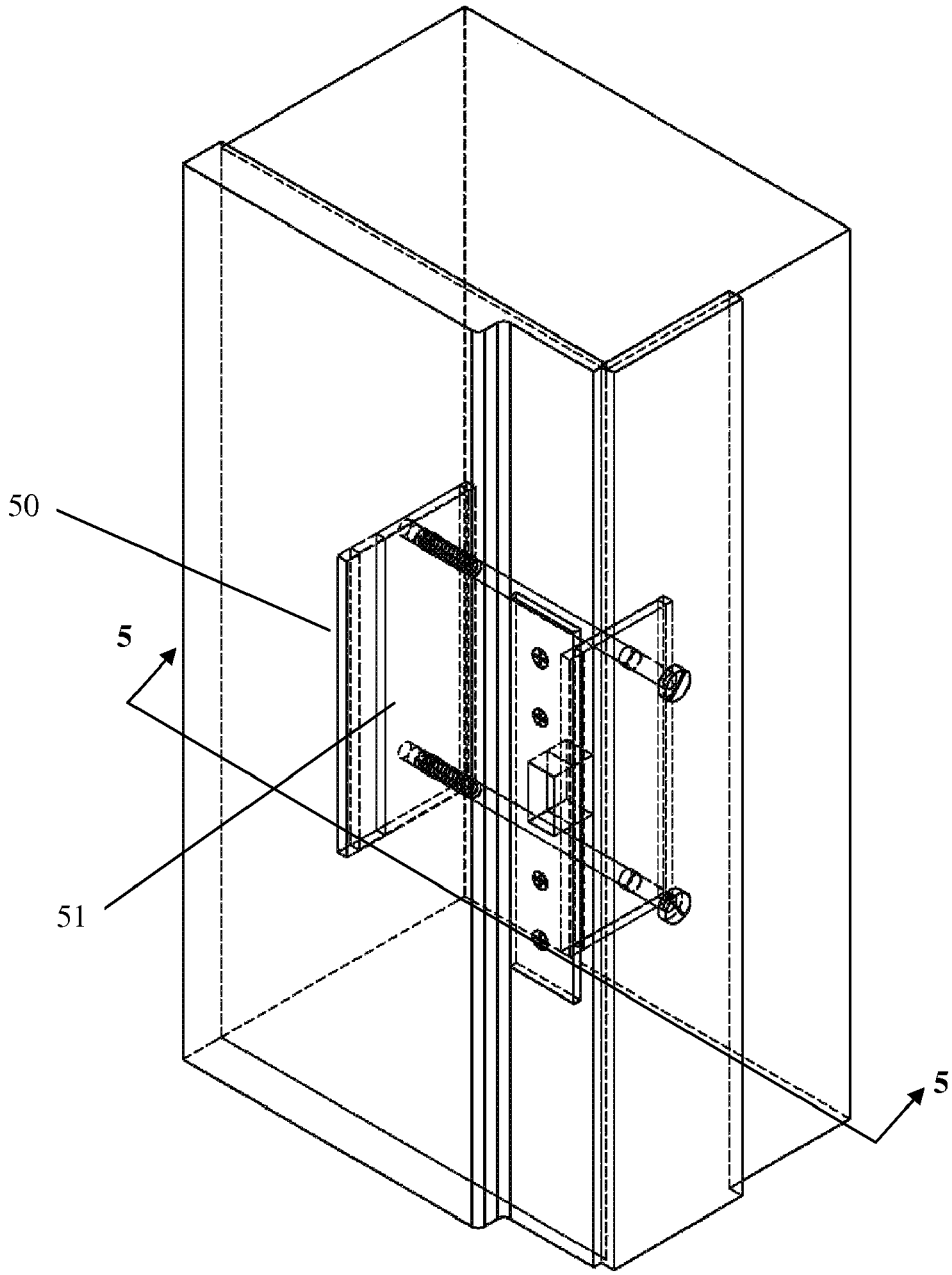
FIG. 4 illustrates a side view of a reinforced door jamb with large striker plate to conceal the reinforced plate
Figure 5:
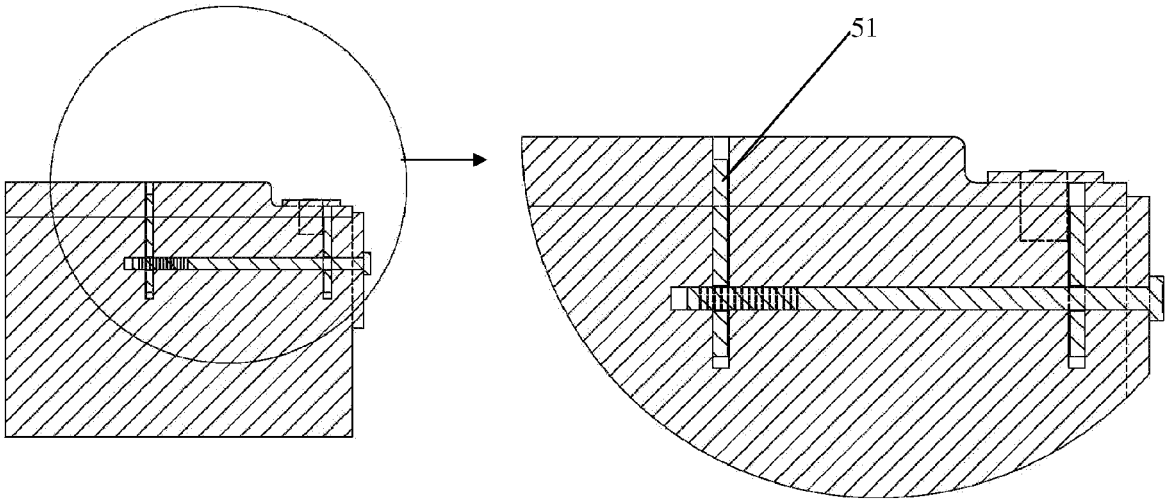
FIG. 5 illustrates a perspective view of another embodiment of the present invention using two reinforced plates.
Figure 6:
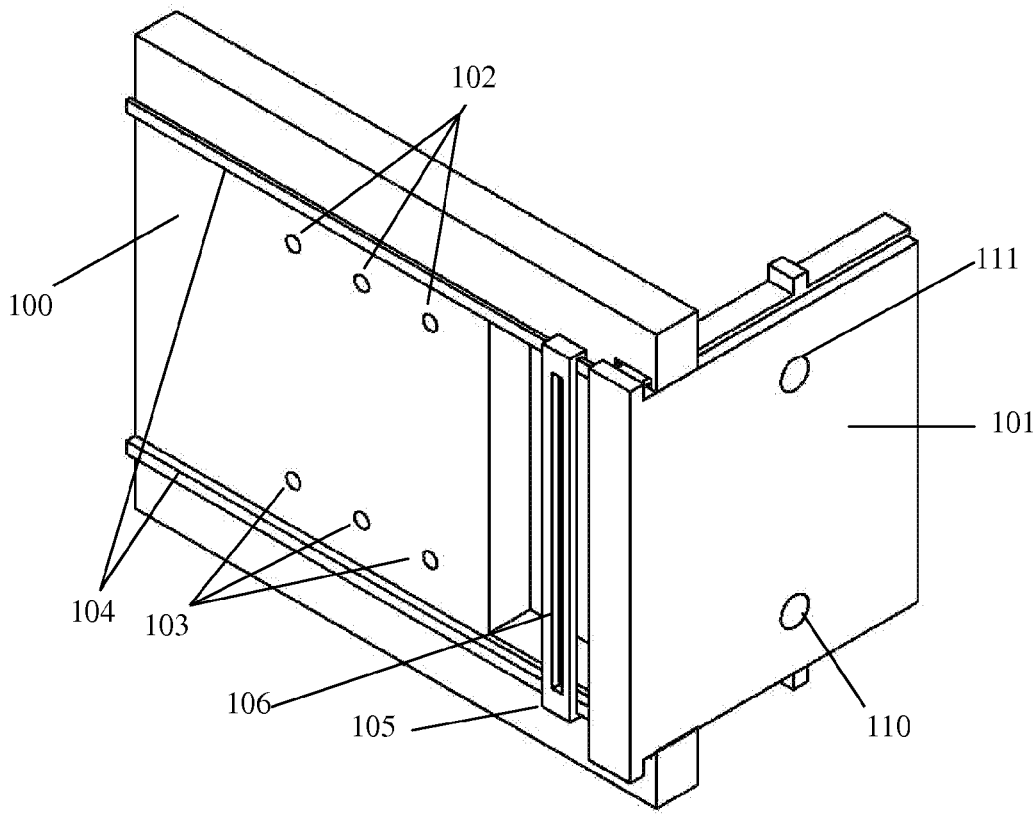
FIG. 6 illustrates a perspective view of a template for preparing the door jamb for installment of reinforcement assembly
Figure 7:
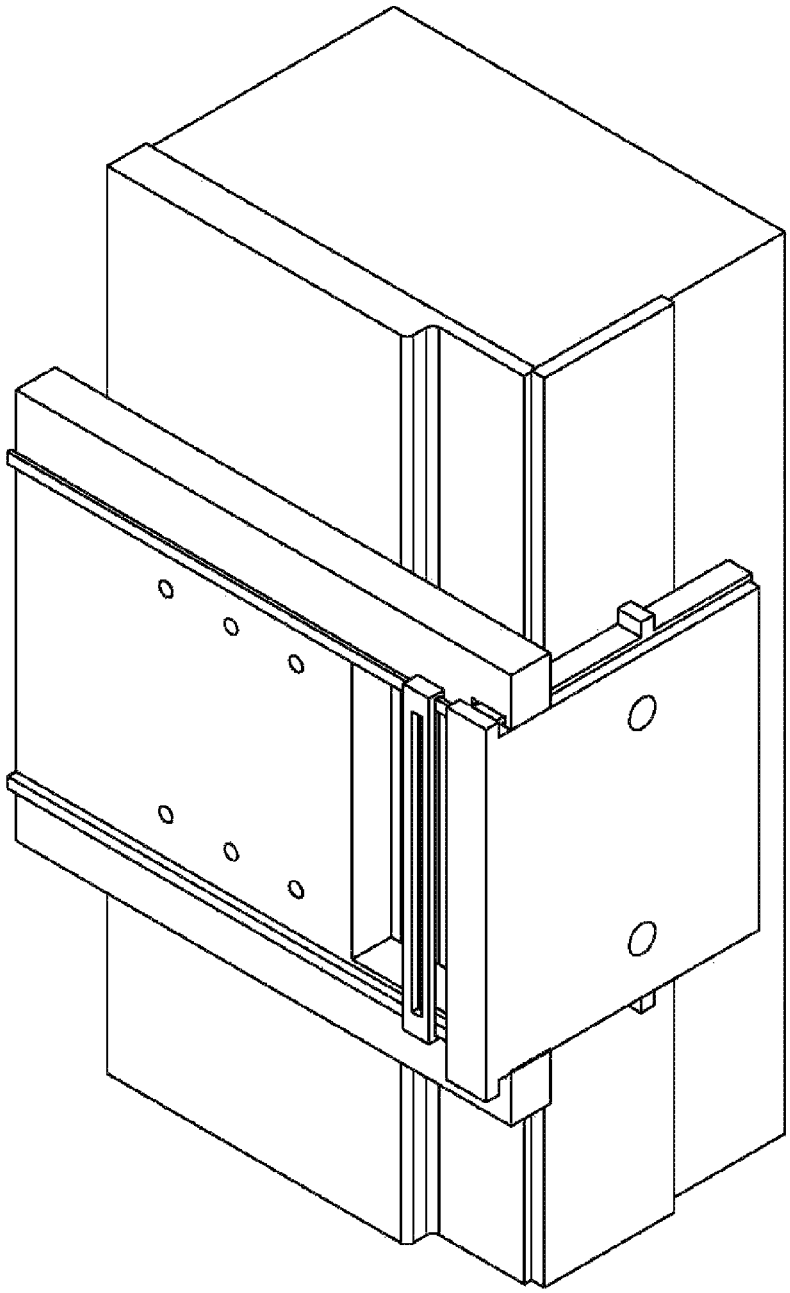
FIG. 7 illustrates a perspective view of a template installed on the door for installment of reinforcement assembly.

In another embodiment of the same invention, as shown in FIGS. 4 and 5, two reinforcement plates, instead of one, are used All features of the reinforcement as described for FIGS. 1-3 are retained However, instead of drilling two openings on the face of the door jamb to insert nuts, a second slot 51 is made to insert the second reinforcement plate 50 The plate may have female threads to receive the bolts. It is also possible to make the openings close to the bolts large enough to insert nuts on the exterior side of the plate and fasten the bolts FIG. 6 shows a template which is used to route and drill the openings on the door jamb precisely and quickly. The template aligns the lateral openings with the transverse openings on the face of the door jamb. The template as disclosed comprises of two rigid plates. One plate 100 attaches to the face of the door jamb and the second plate 101 aligns with the side of the door jamb. Two plate are connected to each other through any conventional connecting means such that they remain at a predesigned angle with respect to each other The first plate, 100 has two rows, 102, 103, of bolt receiving openings along its surface. The openings are set at several locations in order to cover the width of most of the standard door jambs. The first plate has a routing guide receiving guiding rails 104 along its length for a routing guide to slide along said first surface. A routing guide 105 extends between said guide rails. The routing guide has a slot opening 106 to receive a router to rout a slot inside said door jamb The second plate, which is perpendicularly connected to the first plate, can be aligned along the interior side of the door jamb The second plate has two openings, 110, 111, each opening is aligned with each row of openings on the first plate. In order to drill the openings properly, the first plate is affixed onto the face of the door jamb using a pair of openings on its surface and sliding the routing guide along said rails to the desired location on the jamb to route a slot into said jamb. Then the second plate is aligned perpendicular to the first plate along the interior surface of the door jamb, and two openings are drilled through the two openings of the second plate. Then the template is removed and two openings are drilled at the two screw locations at which the template was original affixed to the jamb. The openings such made are perfectly aligned for assembling the reinforcement plates, bolts and nuts. FIG. 7 illustrates the method the template is installed on the door and used to drill the openings and the slots in proper locations and proper alignment.

What is claimed is:

1. A door jamb and door frame reinforcement assembly comprising:

a. a door jamb having a latch receiving face, an interior side and an exterior side, and a jamb width being the distance between the interior and exterior sides of said jamb;

b. said latch receiving face having one or more recesses to receive latches and latch bolts from door locking means;

c. said interior side of said door jamb having at least two openings drilled laterally through a substantial length of said jamb width, said openings being along the latch receiving face of said door jamb;

d. at least two transverse openings drilled on the face of said door jamb to cross said laterally drilled openings along the width of the door jamb;

e. a reinforcement plate having a substantially rectangular surface with a length, a width, and a thickness, said plate having at least two apertures on its surface;

f. said door jamb having a slot routed on its latch receiving face, said slot having dimensions to receive said reinforcement plate, said slot being located adjacent to the latch receiving recess, whereas said reinforcement plate either touching or directly adjacent to said latch receiving recess in the frame itself or to a latch bolt;

g. at least two reinforcing bolts, wherein said reinforcing bolts inserted into said openings of said door jamb, passing through apertures of said reinforcement plate, and extending a substantial length of said jamb width; and h. at least two nuts inserted into said openings on said jamb face to secure said reinforcing bolts, whereby said door jamb being under tension by tightening said reinforcing bolts and nuts and being concealed reinforcement.

2. A door jamb and door frame reinforcement assembly comprising:

a. a door jamb having a latch receiving face, an interior side and an exterior side, and a jamb width being the distance between the interior and exterior sides of said jamb;

b. said latch receiving face having one or more recesses to receive latches and latch bolts from door locking means;

c. said interior side of said door jamb having at least two openings drilled laterally through a substantial length of said jamb width, said openings being along the latch receiving face of said door jamb;

d. a first reinforcement plate having a substantially rectangular surface with a length, a width, and a thickness, said first plate having at least two apertures on its surface, e. a second reinforcement plate having a substantially rectangular surface with a length, a width, and a thickness, said second plate having at least two apertures on its surface, said apertures having treaded tabs to receive reinforcement bolts;

f. said door jamb having a first slot routed on its latch receiving face, whereas said slot having dimensions to receive said first reinforcement plate, and said slot is located adjacent to the latch receiving recess; whereas said first plate being inserted into said first slot in the jamb, and said slot being located adjacent to the latch receiving recess, and whereas said reinforcement plate either touching or directly adjacent to the latch bolt hole in the frame itself or to the latch bolt;

g. said door jamb having a second slot routed on its latch receiving face, whereas said slot having dimensions to receive a flat plate, and said second slot is located close to the exterior side of the door jamb;

h. at least two reinforcing bolts, wherein said reinforcing bolts are inserted into said openings of said door jamb, pass through apertures of said first plate and extend and screw into apertures of said second plate;

wherein said door jamb is put under tension by tightening said reinforcing bolts into the second reinforcement plate.

3. A door jamb and door frame reinforcement assembly of claim 2, whereas said second plate has female threads to receive the said bolts extending through said door jamb, whereby said first plate and said second plate are fastened to each other.

4. A door jamb and door frame reinforcement assembly of claim 2, whereas said second plate is fastened to said first plate using nuts inserted into said second slot.

* * * * *